US006225565B1

(12) United States Patent
Prysner

(10) Patent No.: US 6,225,565 B1
(45) Date of Patent: May 1, 2001

(54) FLEXIBLE CABLE PROVIDING EMI SHIELDING

(75) Inventor: William J. Prysner, Gales Ferry, CT (US)

(73) Assignee: The Untied States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/337,222

(22) Filed: Jun. 7, 1999

(51) Int. Cl.[7] ..... H01B 11/06
(52) U.S. Cl. ..... 174/120 SC
(58) Field of Search ..... 174/36, 102 SC, 174/106 SC, 120 SC; 333/1, 12

(56) References Cited

U.S. PATENT DOCUMENTS 3,609,104 * 9/1971 Ehrreich et al. ..... 252/511
4,499,438 * 2/1985 Cornelius et al. ..... 333/1
4,503,284 * 3/1985 Minnick et al. ..... 174/36
4,816,614 * 3/1989 Baigrie et al. ..... 174/36
5,313,017 * 5/1994 Aldissi ..... 174/36

* cited by examiner

*Primary Examiner*—Dean A. Reichard
*Assistant Examiner*—Chau N. Nguyen
(74) *Attorney, Agent, or Firm*—Michael J. McGowan; Michael F. Oglo; Prithvi C. Lall

(57) ABSTRACT

A flexible cable which includes a Faraday shield sheath formed of a high permeability ferrous alloy filled matrix binder of conductive elastomer, which provides electromagnetic interference (EMI) isolation between the ambient environment about the cable and a conductor line or lines within the cable, or vice versa. The flexible cable shield may be embodied as a flexible electrical cable including at least the elements of a single electrically conductive core, an insulator sheath, and a Faraday shield sheath, and which may be manufactured as a single extruded cable. The conductive property of the matrix binder provides isotropic conductivity within the sheath, which is requisite of an effective Faraday shield. An important embodiment of invention which is implemented using the foregoing concepts is a multiple conductor flexible electrical cable that comprises two or more inner cables as described, and a pile of alternating insulator and a Faraday shield sheaths about the inner cables, similarly manufactured as an extruded pile.

3 Claims, 5 Drawing Sheets

FLEXIBLE CABLE PROVIDING EMI SHIELDING

STATEMENT OF GOVERNMENT INTEREST

The invention described herein may be manufactured and used by or for the government of the United States of America for governmental purposes without the payment of royalties thereon or therefor.

BACKGROUND OF THE INVENTION

1. Field of the Invention

This invention relates to flexible electromagnetic shielding. More specifically, the invention relates to a flexible conductive material and the inclusion of appropriately selected materials of high magnetic permeability. The resulting compound can be extruded as part of the manufacturing process for shielded cables and shielded housings for constituent cable subassemblies.

2. Description of the Prior Art

It is known in the art that sensitive electrical equipment can be affected by Electro-Magnetic Interference (EMI). It is also known in the art that there are several ways to reduce EMI. For example, EMI can be reduced by shielding the electronic equipment by enclosing it in shielded rooms and cabinets, filling any gaps therein with conductive gaskets, and also by shielding cables and cable assemblies connected to the electronic equipment with conductive outer layers.

One example of EMI shielding for rooms and cabinets is disclosed in U.S. Pat. No. 4,992,329 which describes EMI shielding in the form of a laminated sheet. The shielding effect of the sheet is provided by flakes of magnetic amorphous alloy that are deposited between layers of film prior to lamination. Another example is U.S. Pat. No. 4,965,408 which discloses flexible radiation shielding in the form of a laminated sheet. The EMI shielding effect of the sheet is accomplished by laminating a thin metal foil between layers of a flexible outer material.

Examples of conductive elastic gaskets are found in U.S. Pat. Nos. 4,948,922 and 4,937,128 which disclose conductive elastic gaskets used to fill gaps between openings in shielded rooms and cabinets. Both of these patents disclose the use of an elastic material that is electrically conductive in and of itself. Other examples are found in U.S. Pat. Nos. 4,977,295, 4,968,854 and 4,948,922 which disclose conductive elastic gaskets where the elastic material is made conductive through the inclusion of the metallic particles. U.S. Pat. No. 4,966,637 discloses a conductive elastic gasket where the requisite conductivity is provided by an outer wrapping of braided wire.

U.S. Pat. No. 4,920,233 is an example of a special purpose cable which includes a concentric form of Faraday shielding, and incidentally also in alternate embodiments includes a concentric layer of thermoplastic material loaded with ferrite powder. The purpose of that patentee's construction of cabling is to provide a high fidelity music signal transmission media which features consistent phase velocity characteristics over the frequency band of the music, by making the distributed inductance of the cable relatively large. In that patentee's embodiment of FIGS. 1 and 2, the distributed inductance is increased by disposing torroidal ferrite sleeves 28, FIGS. 1 and 2, along the cable's axial length. The function of EMI isolation is also present in that patentee's embodiments of FIGS. 1, 2 and 6 therein, but in the form of twisted metallic foils strips 34 (FIGS. 1 and 2) and 34A (FIG. 6), and a surrounding of metallic braiding (32, FIGS. 1 and 2) and 32A (FIG. 6). This results in a design requiring manufacture by multiple manufacturing steps employing multiple types of manufacturing processes, namely, the extrusion of the thermoplastic elements, and the twisting of a metallic jacket and the braiding of another jacket. This multistep and multimode manufacture in turn drives up direct cost of manufacture and also drives up needs for investment in manufacturing machinery. In another of that patentee's embodiments, FIGS. 6 and 7, the cable inductance is increased by ferrite powder in an extruded thermoplastic layer 26A (FIG. 6) and 48 (FIG. 7). These thermoplastic layers are an electrical insulation material. Thus although the ferrite particles provide inductance for purposes of that patentee's invention, the insulation characteristic of the thermoplastic matrix binder of their layers 26A (FIG. 6) and 48 (FIG. 7) would result in non-homogeneous electromagnetic leakages in the spaces between the ferrite particles, and would not produce the homogeneous conductivity in all directions ("isotropic"), as required of a Faraday shield. U.S. Pat. No. 4,960,965 discloses a cable of concentric layers where an outer layer of EMI shielding comprises conductive carbon fibers. U.S. Pat. No. 4,769,515 discloses a spirally laminated cable comprising an inner metallic core and a laminated outer layer including metallic foil designed to increase the surface area of the metallic conductor, rather than for the purpose of providing EMI protection.

SUMMARY OF THE INVENTION

Accordingly, it is a general purpose and object of the present invention to provide a flexible cable which integrally incorporates a Faraday shield for providing Electro-Magnetic Interference (EMI) isolation between EMI present in the ambient environment and a conductor of the cable, or vice versa.

Another object is to provide such a Faraday shield which yields economies in its manufacture, including savings as a result of need for fewer types of manufacturing machines, and savings in the form of a concentric construction of less-costly-to-fabricate extrudable layers.

This is accomplished by the present invention by using a conductive elastomer as a matrix binder which is filled with particles of a high permeability iron-based alloy. The conductive property of the matrix binder provides isotrophic conductivity requisite of a Faraday shield.

One illustrative embodiment of a flexible cable unit consists of a single conductive core having thereabout a concentric Faraday EMI shielding structure in accordance with the present invention. The concentric shielding structure consists of a concentric pile of alternating (i) sheaths of a flexible insulating material, such as rubber or polyvinyls chloride (PVC), and (ii) Faraday sheaths of a high permeability ferrous alloy particles loaded in a suitable conductive elastomeric matrix binder material, such as CONSIL manufactured by Technical Wire Products. CONSIL is an extrudeable, cure hardened material which prior to extrusion includes both a flowable resin component and a non-flowable component consisting of resin particles which have undergone a preliminary cure and hardening cycle and are pressure distortable. After the ingredients are mixed, the admixture of the matrix binder and the ferrous alloy particles are extruded the admixture is cure hardened, rendering it capable of providing good homogenous (isotropic) conductivity throughout the material. Further details regarding this matrix binder material are described in U.S. Pat. No. 3,609,104 entitled "Electrically Conductive Gasket and Material Thereof," specific portions of which are incorporated by reference later herein in the DETAILED DESCRIPTION OF THE PREFERRED EMBODIMENTS section. The sheath next to the central conductive line of the cable, and the outermost sheath, are of insulation materials. The loading of ferrous alloy particles in the conductive set of alternating sheaths is about 75% by volume, and the size of the particles is 10–20 grains per square inch.

Another illustrative embodiment is a form of what is known in industry as a tri-axial cable. It consists of three conductive lines subassemblies, each with a first insulating sheath directly over the core and a second sheath of the aforesaid conductive, elastomeric, matrix binder loaded with high permeability ferrous alloy particles over the first sheath. These three subassemblies sheaths are bundled and covered by five alternating sets of insulator and Faraday sheaths.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
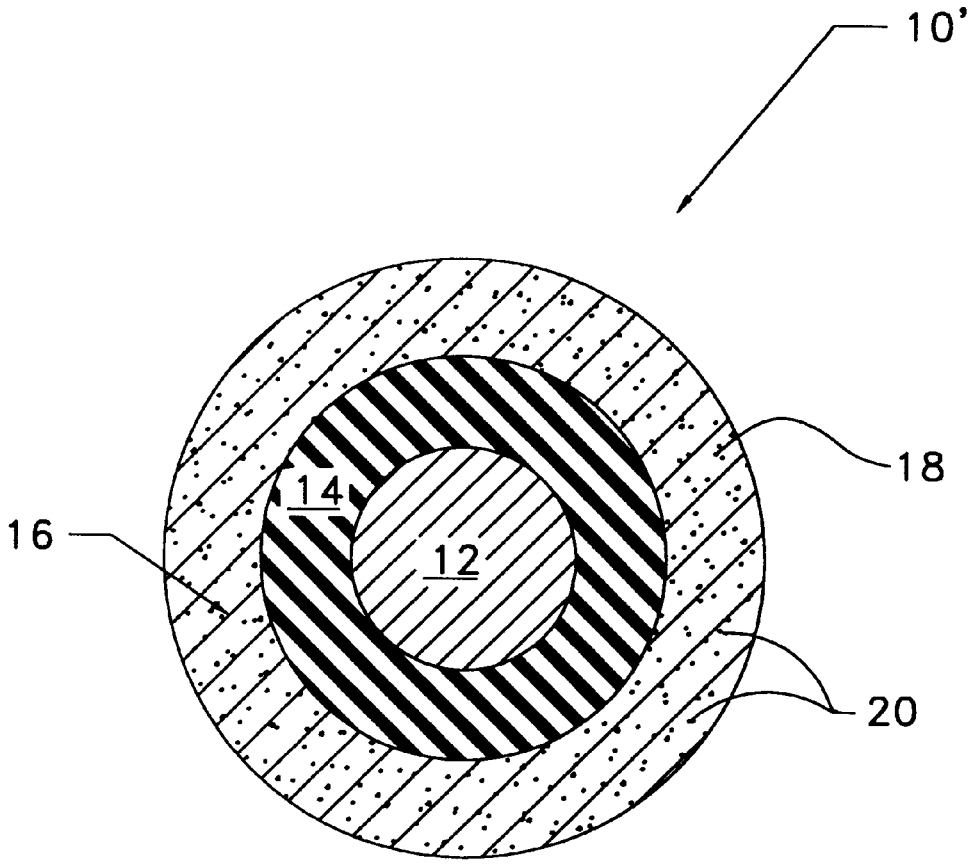
FIG. 1 a cross section of a concentric arrangement of a central conductor, an insulator sheath and a Faraday sheath useful in describing the basic concept of the invention.
Figure 2:
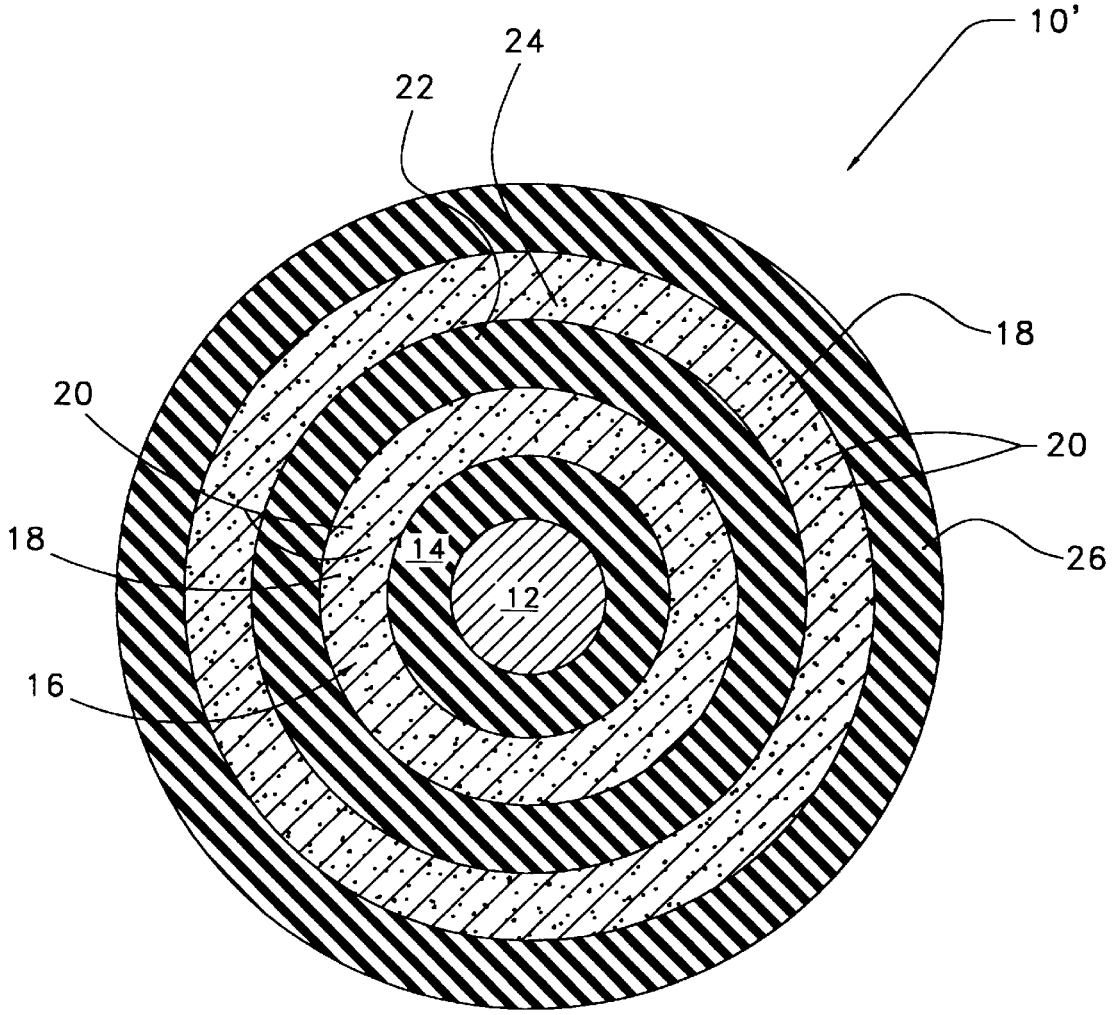
FIG. 2 is a cross-sectional view of a flexible electrical cable embodiment having plural sets of insulator and Faraday sheaths in accordance with the present invention.
Figure 3:
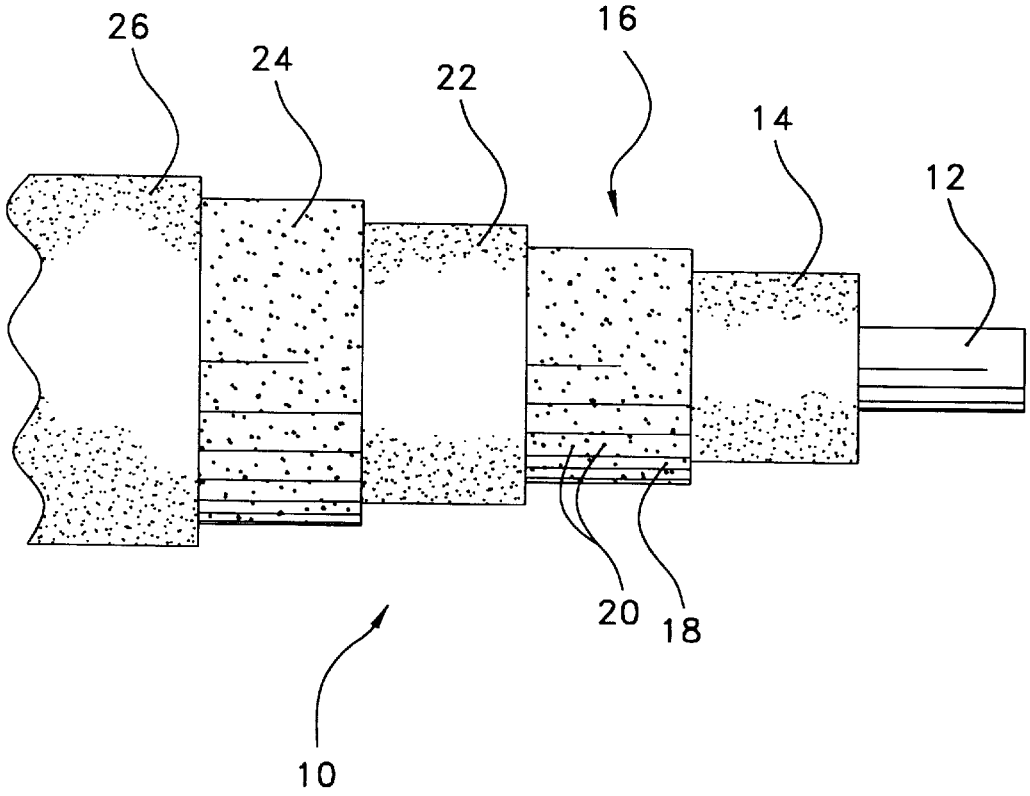
FIG. 3 is side elevation and cutaway view of the cable of FIG. 2.
Figure 4:
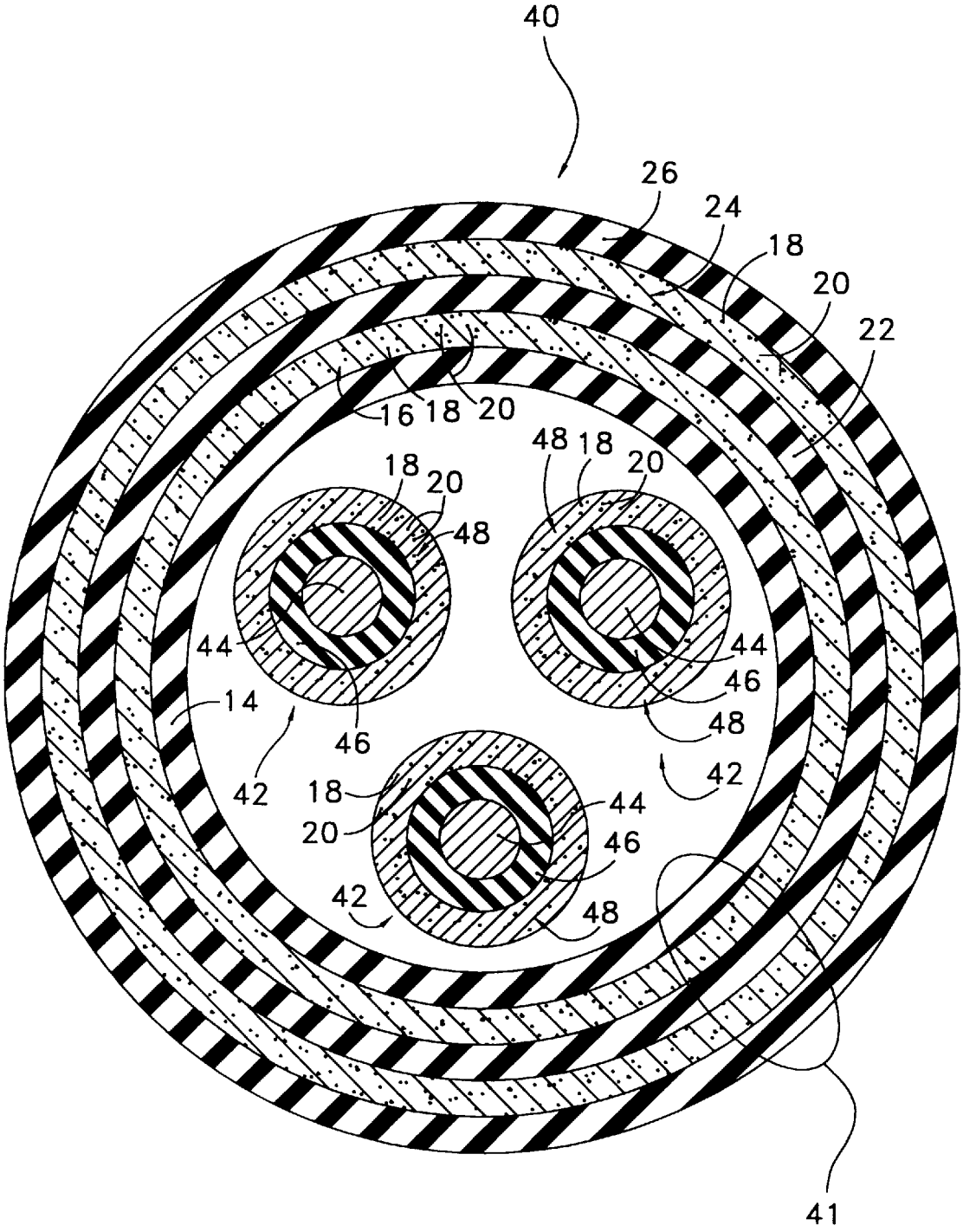
FIG. 4 is a diagrammatic representing a cross-section of a triple conductive line ("triaxial cable") embodiment of the flexible electrical cable in accordance with the present invention.
Figure 5:
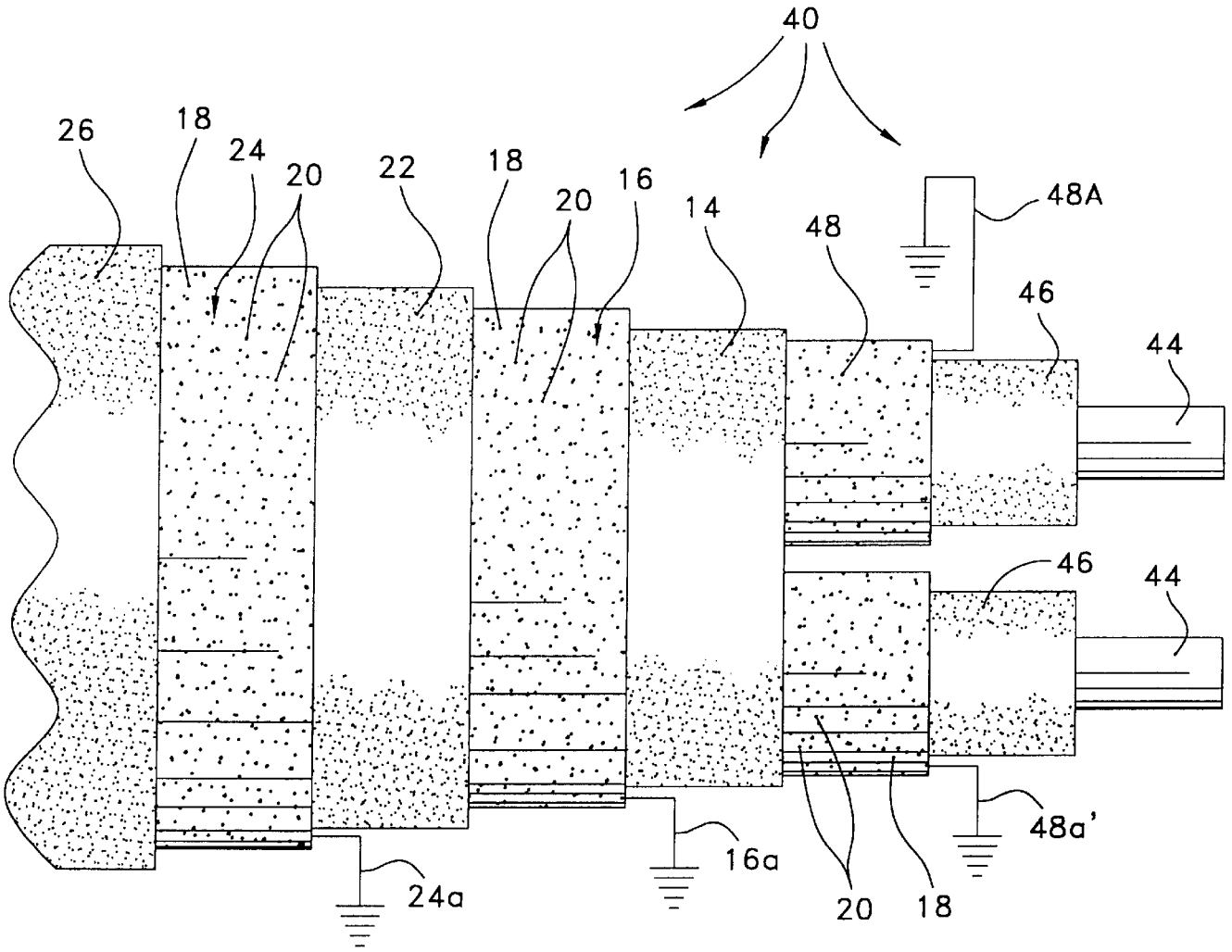
FIG. 5 is a diagrammatic representing a side elevational and cutaway view of the cable of FIG. 4 (but showing only two conductive line subassemblies to avoid clutter).

Referring now to the drawings, there are shown various embodiments of the flexible cables incorporating an ElectroMagnetic Interference (EMI) shield, according to the present invention. The function of the EMI shield of shields present in these embodiments is to provide EMI isolation, or protection, between the external ambient environment and the one or more conductors and the cable, or vice versa. In its most basic form, shown in FIG. 1, the invention may be embodied as a flexible cable 10 consisting of a metal conductor core 12, surrounded by an insulator sheath or layer 14, which in turn is surrounded by an EMI shield sheath or layer 16. In general, electrically conductive core 12 is used to transmit electrical signals and power. Insulator 14 electrically isolates the conductor and the EMI shield 16. The EMI shield sheath 16 protects the electrically conductive core 12 against the induction thereinto of EMI from ambient space, or vice versa. In a typical application EMI shield sheath 16 would be grounded, but this is has little bearing on broader aspects of the invention. It will be appreciated that EMI shield sheath 16 constitutes what in physics and electrical engineering is known as a Faraday shield. It is to be understood that under the aegis of the broad concept of the inventions illustrated by FIG. 1, any number of these three elements can be combined to create a flexible electrical cable, and the outermost layer beyond at least one EMI shield sheath may be an insulator to avoid the cable presenting a short circuit hazard in cabling environments which include electrically "hot" terminal connectors and the like. FIGS. 2 and 3 and FIGS. 4 and 5 respectively show two embodiments suitable for cabling applications wherein EMI isolation is particularly critical. Illustrative of a cabling application wherein EMI isolation is particularly critical are (i) "strapped together" expanses of a plurality of data buses, and (ii) a plurality of data buses which pass through tight wall penetrations. There can be situations in which the introduction of EMI induced data error in one or more of these data buses could cause serious equipment disruption or even hazard to life. The embodiment, shown in FIGS. 2 and 3, is a single flexible electrical cable 10 with a single electrically conductive core 12. Another embodiment, shown in FIGS. 4 and 5, is a flexible electrical cable 40 with a plurality of electrically conductive cores 44. The first embodiment is used when a single EMI shielded conductor is needed, and may be manufactured in a continuous cable forming process. The second type of cable is normally used when several conductors are to be shielded, although it may also be used to just shield a single conductor. While the second type of cable is normally assembled as a cable assembly of specific length, it too may be manufactured in continuous or near-continuous form. The resulting cable may be part of organization including a larger number of components such as electrical connectors 16*a*, 24*a*, 48*a*, and 48*a*'attached to the ends of the cable assembly (including grounding of the EMI shield sheaths 16 and 24 shown in FIGS. 2 and 3; and EMI sheaths 48, 16 and 24 shown in FIGS. 4 and 5).

Referring now to FIGS. 2 and 3, there is shown a flexible single-conductor embodiment of, multilayered EMI shielding cable 10, which is generally comprised of various combinations of three types of constituent elements namely: the electrically conductive core 12 to be isolated, or protected; insulators 14, 22 and 26; and EMI shields 16 and 24.

Referring to FIGS. 4 and 5 there is shown a flexible, multiconductor, multilayered embodiment of EMI shielding of cable 40 of the type frequently referred in the industry as a triaxial cable. It is possible, however, for the EMI shield of the present invention to be embodied in cables having fewer or more layers than those shown in the drawings. The arrangement, quantity, and thickness of the layers can be varied as required by the end use of the cable.

Referring again to the single conductor embodiment of cable 10 (FIGS. 2 and 3), electrically conductive core 12 is generally of circularity-sectioned drawn wire stock, and is made of an electrically conductive material selected for its conductivity, weight, compatibility and cost. Examples of such electrically conductive material include copper, silver and gold.

A first insulator sheath 14 is concentrically disposed about core 12 and surrounds and insulates the core from other conductive materials. A second insulator sheath 22 constitutes another insulating sheath, and a jacket 26 likewise provides further electrical isolation. First insulator 14, second insulator 22, and outer insulator 26 may be selected from numerous flexible insulating materials based on considerations of insulative properties, weight, flexibility and cost. Examples of such insulators include rubber or polyvinyl chloride (PVC). Each insulator can be of a different material from the other insulators, each material being selected as required by the end use of the cable.

Concentrically disposed about insulator 14 is EMI shield sheath 16, where it surrounds insulator 14, as well as surrounds electrically conductive core 12. Similarly, a second EMI shield 24 concentrically surrounds second insulator 22 as well the other layers as shown. Both first EMI shield 16 and second EMI shield 24 are a high permeability metal-filled conductive elastomer comprised of a conductive, elastomeric, matrix binder 18 and embedded metal particles 20. The preferred method of manufacturing a shield of the present invention is to mix metal particles 20 with a flowable liquid component that is elastomeric in its solid state, but there are other methods that could be used to produce a shield of the present invention.

Conductive elastomeric matrix binder 18 can be selected from any suitable conductive elastomer based on considerations of degree of conductivity, weight, flexibility and cost. One example is CONSIL (manufactured by Technical Wire Products), which is described in U.S. Pat No. 3,609,104 (earlier identified in the SUMMARY OF INVENTION section) as an admixture of a flowable component of thermosetting resin, and non-flowable particles of thermosetting resin which have undergone a preliminary curing and hardening phase that rendered the particles pressure distortable. The high permeability ferrous alloy particles are loaded in the admixture during the formation of a sheath by a conventional extrusion process which also performs curing and hardening of the sheath. For a more detailed description of matrix binder material 18, see the aforesaid U.S. Pat. No. 3,609,104, the portion thereof starting at its column 5, line 31 through column 11, line 14 being hereby incorporated herein by this reference.

It is to be appreciated that the term "elastomer" and its adjective form "elastomeric" as used in this specification and in the appended claims are intended to encompass both mixtures including natural rubber material and mixtures including synthetic rubbers or plastics having some of the physical properties of natural rubber.

Metal particles 20 can be selected from numerous high permeability, ferrous alloy materials similarly selected based on considerations of conductivity, weight, degree of magnetic permeability and cost. Insofar as the invention is presently understood, the use of a conductive matrix binder to receive the high permeability ferrous alloy particles contributes significantly to suppression of EMI leakage paths, which is the primary objective of the present invention. A specific class of commercially available ferrous alloys believed effective for use as particles 20 consist of: (i) 4–79 Permalloy, (ii) MUMETAL, (iii) Hymu 80, (iv) 45 Permalloy, and (v) 50% nickel iron. (MUMETAL is a registered trademark of Spang and Company, of Butler, Pennsylvania.) One commercial source of these metals in appropriate powder metal form is Carpenter Technology Corporation, of Reading, Pennsylvania. The metal particles range in size from approximately 10 to 20 grains per square millimeter.

The conductive elastomer with which these metal particles are composited in order to form an extrudable composition is the matrix binder material in which the particle are loaded. For purposes of the invention, the higher the percentage of metal particles, the more effective layers 16, 24 and 48 are in providing the electromagnetic shielding function. One embodiment of invention employs a composition in which the percentage, by volume, of the metal particles in the composition is seventy-five percent (75%).

While it is possible for the components of the embodiment to be manufactured separately and then assembled to form a completed cable, the preferred method of manufacturing the single conductor embodiment of FIGS. 2 and 3 is to make a cable as a single unit by extruding the concentric pile of sheaths or layers about the conductor. The resulting flexible electrical cable 10 has a central axis corresponding to the middle of core 12.

Referring again to the multiple-conduction line type of cable 40, FIGS. 4 and 5, a set of outer external-to-the-conductor-lines-subassembly 41 surrounds and isolates, or protects, one or more inner-conductor-line-subassemblies 42 containing individual conduction lines. Stated another way an outer subassembly of concentric sheaths 41 surrounds, or encompasses, a set of individual conductor cable subassemblies 42. The particular multiconductive, multilayered cable depicted therein has a conduction core comprised of three individual conductor line cables, or conductor-line-subassemblies 42, and is of the type frequently referred to in the industry as a "triaxial cable". Each conduction line cable 42 is a subassembly of cable 40. It is possible, however, for the present invention to be embodied in the form of cables having fewer or more layers and fewer or more inner cables than those shown in the drawings. The arrangement, quantity, design and thickness of the layers and inner cables can be varied as required by the end use of the design cable. A set of outer, or extra-conductor-line-subassembly, Faradays sheaths 41 is generally comprised of combinations of insulators 14, 22 and 26 and Faraday shield sheaths disposed between insulators and 24. These components serve the same purposes as the corresponding components discussed in connection with the single-conductor cable of FIGS. 2 and 3.

Each individual conduction line cables 42 is generally comprised of various combinations of three components: an inner electrical conductor or core 44, a sheath or layer of insulating material 46, and a layer of high-permeability-ferrous-alloyparticle-filled-conductive, elastomeric matrix binder 48. While it is possible for the components of the set of external-to-the-conductor-lines-assembly 44 to be manufactured separately and then assembled to form a complete housing, the preferred method of manufacturing a set of sheaths 41 is by extruding the appropriate sheaths layers sheaths or as a generally concentric pile of sheaths having a nominal central axis disposed at the center of the bundle of cables 42.

The number and construction of each inner cable 42 may vary depending on the anticipated end use of the cable. In fact, a flexible electrical cable 10, FIGS. 2 and 3, can be used as an inner cable 42.

It is to be a appreciated that an important aspect of the present invention is the discovery, or inventive appreciation, that the utilization of a matrix binder material that has the property of being a conductive material yields the desired effect of substantially isotropic conductivity within Faraday shield sheaths 16 (FIGS. 1, 2, 3, 4 and 5), 24 (FIGS. 2, 3, 4 and 5), and 48 (FIG. 5), which is a necessary characteristic of an effective Faraday shield.

Obviously, many modifications and variations of the present invention may become apparent in light of the above teachings. For example, while the above description has emphasized the function of high permeance, ferrous alloy-filled, elastomeric conductive matrix binder sheaths 16 (FIGS. 1, 2, 3, 4 and 5), 24 (FIGS. 2, 3, 4 and 5), and 48 (FIG. 5) as EMI shielding, it will be appreciated that there may be a design requirement for the cable to provide additional conductive paths for signals or power, and any or all of the matrix binder sheaths may serve the additional function of providing these paths. It is therefore to be understood that within the scope of the appended claims, the invention may be practiced otherwise than as specifically described.

What is claimed is:

1. A multi-conductor flexible cable assembly providing Electro-Magnetic Interference (EMI) isolation, comprising:

a set of a plurality of individual conductor cable subassemblies;

each individual conductor cable subassembly comprising a metallic conductor, an insulating sheath about the conductor, and a Faraday shield sheath made of an elastomeric conductive matrix binder having loaded therein high permeability particles of a ferrous material disposed about the insulating sheath and forming the outermost layer of said each individual cable subassembly;

an outer subassembly of a pile of at least five concentric sheaths comprising radially alternating sheaths with the innermost sheath and the outermost sheath of the pile being other insulating sheaths, and with Faraday shield sheaths disposed between each radially successive pair of insulator sheaths, said Faraday shield sheaths each being made of an elastomeric conductive matrix binder having loaded therein high permeability particles of a ferrous material; and said pile of concentric sheaths of said outer subassembly being in the structural form of a concentric pile of successive cured and hardened extrusions upon one another in the radial outward direction.

2. A cable in accordance with claim 1 wherein said set of a plurality of individual conductor cable subassemblies comprises two individual conductor-line subassemblies.

3. A cable assembly in accordance with claim 1 wherein the Faraday shield of each individual conductor cable subassembly, and each Faraday shield of the pile of concentric sheaths of the outer subassembly, have individual connectors to ground at the opposite ends of the multi-conductor cable assembly.

* * * * *